US008403028B2

(12) United States Patent
Groezinger

(10) Patent No.: US 8,403,028 B2
(45) Date of Patent: Mar. 26, 2013

(54) WATER-SOLUBLE SALT CORES

(75) Inventor: Dieter Groezinger, Wilhermsdorf (DE)

(73) Assignee: Kolbenschmidt Aluminum Technologie GmbH, Neckarsulm (DE)

( * ) Notice: Subject to any disclaimer, the term of this patent is extended or adjusted under 35 U.S.C. 154(b) by 0 days.

(21) Appl. No.: 13/367,380

(22) Filed: Feb. 7, 2012

(65) Prior Publication Data

US 2012/0132785 A1 May 31, 2012

Related U.S. Application Data

(63) Continuation of application No. 10/591,198, filed as application No. PCT/DE2004/002718 on Dec. 11, 2004, now abandoned.

(30) Foreign Application Priority Data

Dec. 17, 2003 (DE) ..... 103 59 547

(51) Int. Cl.

| | |
|---|---|
| ***B22C 1/04*** | (2006.01) |
| ***B22C 9/00*** | (2006.01) |
| ***B22C 1/22*** | (2006.01) |

(52) U.S. Cl. ..... 164/522; 164/28; 164/528

(58) Field of Classification Search ..... 164/28, 164/522, 369, 528

See application file for complete search history.

(56) References Cited

U.S. PATENT DOCUMENTS 2,878,539 A * 3/1959 Halpern et al. ..... 164/21
3,764,575 A * 10/1973 Anderko et al. ..... 523/143
5,573,055 A * 11/1996 Melling et al. ..... 164/15

FOREIGN PATENT DOCUMENTS

SU 1196096 * 12/1985

* cited by examiner

*Primary Examiner* — Kevin P Kerns
*Assistant Examiner* — Steven Ha
(74) *Attorney, Agent, or Firm* — Norman B. Thot

(57) ABSTRACT

The invention provides water-soluble salt cores which are produced by compacting a mixture of water-soluble salts and a binding agent, under pressure and subsequently subjecting them to heat-treatment. The binding agent is an inorganic phosphate or a mixture of inorganic phosphates having a proportion of between 0.5 and 10 wt. % of the mixture.

1 Claim, No Drawings

WATER-SOLUBLE SALT CORES

CROSS REFERENCE TO PRIOR APPLICATIONS

This application is a continuation of application Ser. No. 10/591,198, filed on Aug. 30, 2006, which is a U.S. National Phase application under 35 U.S.C. §371 of International application Ser. No. PCT/DE2004/002718, filed on Dec. 11, 2004 and which claims benefit to German Patent Application No. 103 59 547.3, filed on Dec. 17, 2003 . The International Application was published in German on Jun. 30, 2005 as WO 2005/058527 A1 under PCT Article 21(2).

FIELD

The present invention relates to water soluble salt cores having the features of the preamble of claim 1.

BACKGROUND

Such salt cores for casting purposes that are flushed out of parts after casting as well as attempts at optimizing them by admixing additives have been long known. In DE-C-14 83 641 it has been found that adding up to 10% of borax, magnesium oxide or talcum improves the load capacity of salt cores consisting of NaCI and/or KCI. DE-A-19 34 787 proposes to add a synthetic resin binder and water glass in order to avoid pressing and sintering. These admixtures are also known from U.S. Pat. No. 3,764,575.

The use of synthetic resin binders however is very problematic since they are subject to carbonization and outgassing. This is disadvantageous for casting so that the salt cores are usually pre-heated to a temperature of 600° C. in order for outgassing to occur prior to casting. Since the synthetic resin binders for their main part release stressing gases, a suction means is needed for this process. Another problem arises from the manipulation of the very hot salt cores when placing them into the casting mold. From DE 195 25 307 A1 it is known to manufacture a casting core from perlite, sodium hexametaphosphate and water.

SUMMARY

It is the object of the present invention to avoid the problems described by utilizing an alternative binder and to provide salt cores that have already sufficient tensile strength at a sintering temperature of from 200° C., will not be subjected to outgas sing at temperatures lower than 700° C. and are adapted to be utilized with all known casting types.

This object is solved with the features recited in claim 1. Advantageous embodiments and developed implementations of the invention and in particular a method of the invention are comprised in the other claims.

DETAILED DESCRIPTION

In accordance with the invention, water soluble salt cores that are manufactured compacting a mixture of water soluble salts and a binder under pressure and subsequently sintering said compacted mixture are characterized in that the binder is an inorganic phosphate or a mixture of inorganic phosphates with a fraction of between 0.5 and 10 wt. % of the mixture. The mixture can contain a fraction of an inorganic borate. At low compression pressure, a high fraction of binder yields quite rough a surface, whereas at high compression pressure a low fraction of binder yields a smooth surface. At a sintering temperature of 200° C., tensile strengths of between 1 and 3 kg, at 400° C. of between 2 and 3 kg are achieved.

According to an advantageous implementation of the invention, the mixture contains a fraction of between 0 and 10 wt. % of a parting agent such as graphite.

The inorganic phosphate is for example a monoaluminium phosphate, a boron phosphate or a sodium polyphosphate.

Heat treatment is carried out at temperatures of below 730° C., preferably at temperatures ranging between 200° C. and 650° C., so that the aggregate state of the salt cores will not change.

The invention will be illustrated in greater detail herein after by way of example only with reference to tests. Tensile strength was determined by means of a pneumatically operated spring scale with maximum pointer, said maximum pointer indicating a kilogram value when the clamped sample broke.

Test 1

97.5 wt. % of salt with a grain size of 0.16-0.7 mm,
1.5 wt. % of monoaluminium phosphate,
1 wt. % of graphite
were compacted and thermally treated. The tensile strength obtained were
about 3 kg at 200° C.,
about 3 kg at 300° C.,
about 3 kg at 400° C.,
about 4.5 kg at 500° C.

Test II 97.5 wt. % of salt with a grain size of 0.16-0.7 mm
1.5 wt. % of boron phosphate
1 wt. % of graphite were
compacted and thermally treated. The tensile strength obtained were
about 2.4 kg at 200° C.,
about 2.5 kg at 300° C.,
about 2.5 kg at 400° C., about 3-3.5 kg at 500° C.

Test III 97.5 wt. % of salt with a grain size of 0.16-0.7 mm
1.5 wt. % of sodium polyphosphate
1 wt. % of graphite
were compacted and thermally treated. The tensile strength obtained were
about 1.3 kg at 200° C.,
about 1.4 kg at 300° C.,
about 2 kg at 400° C.,
about 4 kg at 500° C.

Test IV 97.5 wt. % of salt with a grain size of 0.16-0.7 mm
1.5 wt. % of boron phosphate with a fraction of an inorganic borate
1 wt. % of graphite
were compacted and thermally treated. The tensile strength obtained were
about 1.5 kg at 200° C.,
about 1.75 kg at 300° C.,
about 2.5 to 3 kg at 400° C.,
about 3 to 4 kg at 500° C.

With these formulations the cost-expensive pre-heating process in the casting house can be eliminated, the salt cores can be automatically inserted at relatively low temperatures and outgassing will not occur. Also, thermal treatment occurs at temperatures clearly below the sintering temperature (730° C.), which reduces the amount of energy needed to manufacture the cores.

What is claimed is:

1. A method for producing a water soluble salt core for castings, the method comprising:

providing a water soluble salt(s);

mixing the water soluble salt(s) with between approximately 0.5 to 10 wt.-% of a binder and between approximately 1 and 10 wt.-% of a parting agent comprising graphite so as to provide a mixture, both based on a total weight of the mixture, wherein the binder is an inorganic phosphate or a mixture of inorganic phosphates comprising at least one of a monoaluminium phosphate, a boron phosphate, and a sodium polyphosphate;

compacting the mixture; and sintering the compacted mixture at approximately 200° C., wherein, the mixture is not subjected to an outgas sing at a of temperature below 700° C. during a heating process in a subsequent thermal treatment, and wherein, the mixture does not contain water.

* * * * *